US005108105A

United States Patent [19]

Shimizu

[11] Patent Number: 5,108,105

[45] Date of Patent: Apr. 28, 1992

[54] GOLF PRACTICE DEVICE

[75] Inventor: Tetsuo Shimizu, Matsudo, Japan

[73] Assignee: Maruman Golf Kabushiki Kaisha, Tokyo, Japan

[21] Appl. No.: 641,810

[22] Filed: Jan. 16, 1991

Related U.S. Application Data

[63] Continuation of Ser. No. 408,341, Sep. 18, 1989, abandoned.

[30] Foreign Application Priority Data

Sep. 22, 1989 [JP] Japan ..... 63-236259

[51] Int. Cl.[5] ..... A63B 69/36

[52] U.S. Cl. ..... 273/186 R; 273/183 R; 273/186 A; 273/186 C

[58] Field of Search ..... 273/183 R, 183 A, 186 R, 273/186 A, 186 C

[56] References Cited

U.S. PATENT DOCUMENTS 4,477,079 10/1984 White ..... 273/186 R
4,542,906 9/1985 Takase et al. ..... 273/183 A
4,577,868 3/1986 Kiyonaga ..... 273/183 A
4,615,526 10/1986 Yasuda et al. ..... 273/183 A
4,858,934 8/1989 Ladick et al. ..... 273/183 A

FOREIGN PATENT DOCUMENTS 61-125361 6/1986 Japan .

*Primary Examiner*—William H. Grieb
*Assistant Examiner*—Jessica J. Harrison
*Attorney, Agent, or Firm*—Armstrong, Nikaido, Marmelstein, Kubovcik & Murray

[57] ABSTRACT

A golf practice device comprising a mat with at least two sensors arranged therein in the direction of a swing orbit of a head of a golf club. A swing time substantially from a start of a back swing to a point of an impact with a golf ball is calculated in response to signals output by the sensors, and the result is indicated so that a golfer can observe same and thus achieve a stable swing. It is possible to distinguish an address motion and an actual swing before impact by adapting a special combination of the outputs of the two sensors.

4 Claims, 4 Drawing Sheets

Fig. 3
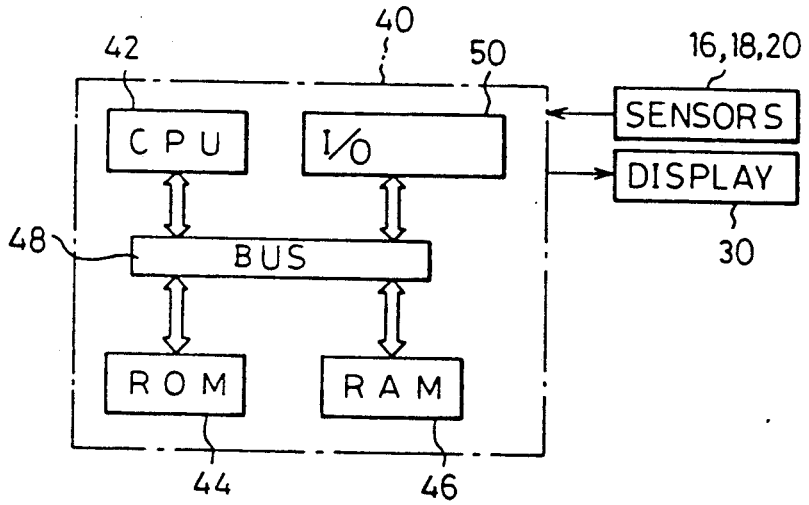
Fig. 4A
Fig. 4B
Fig. 4C
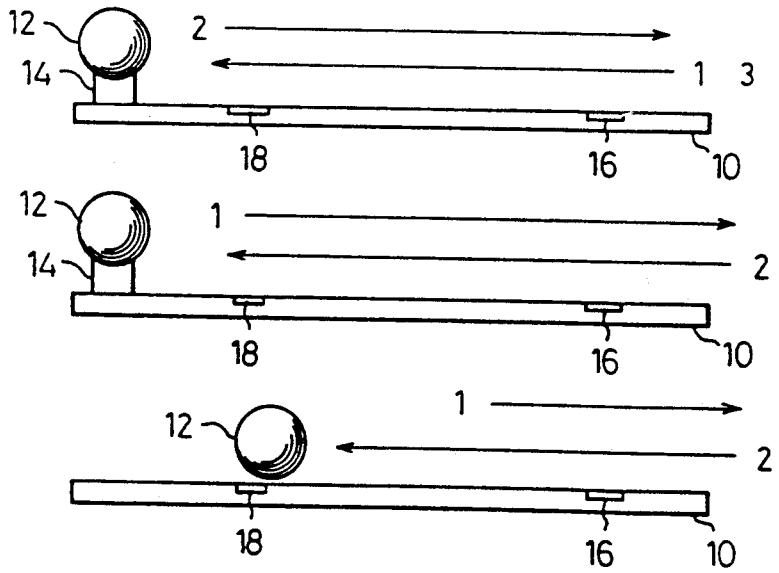

GOLF PRACTICE DEVICE

This application is a continuation of application Ser. No. 408,341, filed Sep. 18, 1989.

BACKGROUND OF THE INVENTION

1. Field of the Invention

The present invention relates to a golf practice device able to calculate and indicate a swing time substantially from a start of a backswing of a golf club to an impact of the head thereof with a golf ball.

2. Description of the Related Art

Conventionally, golf practice is carried out using a mat on which a golf ball can be set, and in connection with such a golf practice mat, golf practice devices have been proposed by which data of a swing of a golf club can be measured.

For example, Japanese Unexamined Patent Publication No. 61-125361 discloses a swing measuring device used when practicing a swing of a golf club. This device obtains measured data based on an output from a detecting means for detecting a state of a swing of a golf club, compares the measured data with stored predetermined reference data, and outputs corrective data based on the compared result, to enable an improvement of the swing. According to this publication, a plurality of magnetic sensors can be used as the detecting means, and it is possible to calculate the measured data, such as the speed of a head of a golf club during a swing from the output of the detecting means.

Conventional golf practice devices are mainly directed to measuring and improving the speed of the golf club head at the instant of an impact thereof with the golf ball. Also, it is possible to measure a swing orbit, a face angle at the instant of impact with the ball, a position of an impact, and so on, but it is very difficult to display the data numerically, and accordingly, usually these items are measured and the data displayed by a visual detecting means such as a video tape.

It is difficult for an average golfer to pay attentions to too many points during a swing. Also, problems sometimes arise in that the body of the golfer becomes stiff or moves out of position when the golfer swings a golf club while using a golf practice device, so that the swing is poor when using such a device. In particular, beginners have a problem with the backswing and top positions before tackling the problems of impact, and many golfers cannot actually use conventional golf practice devices which require the user to concentrate on the impact.

SUMMARY OF THE INVENTION

The object of the present invention is to solve the above problems by enabling a golfer to make a stable swing of a golf club without undue tension, and to provide a golf practice device by which it is possible to calculate and indicate a swing time substantially from a start of a backswing of a golf club to an impact of the head thereof with a golf ball.

According to the present invention, the golf practice device comprises a mat on which a golf ball can be set, at least two sensors arranged in the mat and spaced from each other in the direction of a swing orbit of a head of a golf club, a swing time calculating means for calculating a swing time substantially from a start of a backswing of the golf club to an impact of the head with a golf ball, in response to outputs of the at least two sensors, and an indicating means for indicating a result obtained by the swing time calculating means.

With this arrangement, a swing time substantially from a start of a backswing of the golf club to an impact of the head with a golf ball is calculated based on the outputs of the at least two sensors spaced from each other in the direction of a swing orbit of a head of a golf club, and the calculated swing time is indicated by the indicating means, and thus the golfer can observe the indicated time and practice until achieving a swing at a constant rhythm. Note, the distance of flight of the golf ball will become longer if the swing time becomes constant. Also, it is possible to practice the different swing needed for each golf club.

BRIEF DESCRIPTION OF THE DRAWINGS

The present invention will become more apparent from the following description of the preferred embodiment with reference to the accompanying drawings, in which:

FIG. 3 is a schematic diagram of a microcomputer included in the indicating means in FIG. 1;

FIG. 4A to 4C are views illustrating examples of different golf swings in relation to the sensors on the mat;

DESCRIPTION OF THE PREFERRED EMBODIMENTS

Figure 1:
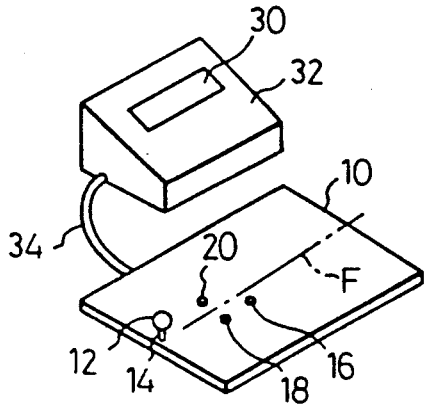
FIG. 1 is a perspective view of a golf practice device according to the present invention.
Figure 2:
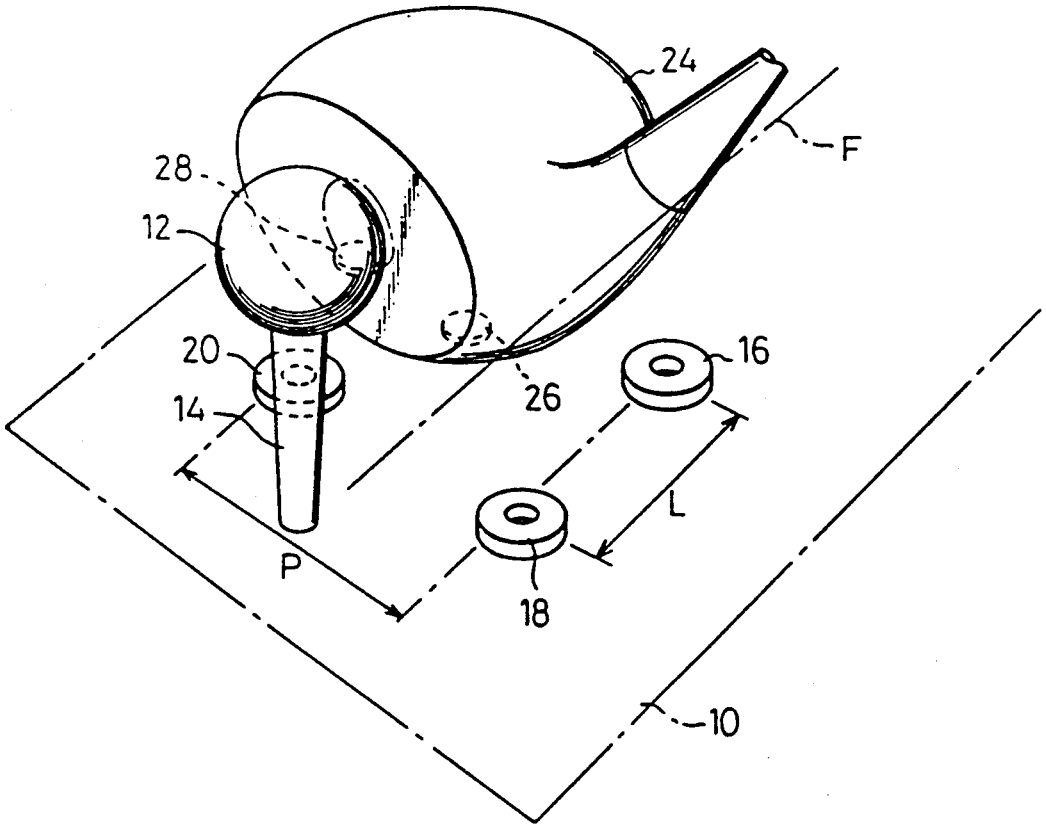
FIG. 2 is a partially enlarged view of the mat of FIG. 1.

Referring to FIGS. 1 and 2, 10 represents a flat golf practice mat having a tee 14 upon which a golf ball 12 can be set near the front edge of the mat 10. The tee 14 can be detached from the mat 10 and the golf ball 12 set directly on to the mat 10.

The sensors 16, 18 and 20 are arranged in the mat 10. These sensors 16, 18 and 20 are sensitive to a magnet field and thus permanent magnets 26 and 28 are embedded in a head 24 of the golf club, whereby these sensors 16, 18 and 20 detect changes of the magnetic flux to thereby detect the passage of the head 24 of the golf club. The sensors 16, 18 and 20 may be a type other than that sensitive to a magnetic field, for example, photoelectric sensors may be used for the same purpose.

At least two of the sensors 16, 18 and 20 are arranged in the mat 10 in such a manner that they are spaced from each other in the direction of a swing orbit. The first sensor 16 and the second sensor 18 are on one side, i.e., near the golfer, of the anticipated center line F of a swing orbit passing through the tee 14, and the first sensor 16 is located apart from the second sensor 18 at a distance L. The third sensor 20 is on the other side, i.e., away from the golfer of the center line F of the swing orbit and is located at a position symmetric to the second sensor 18 with regard to the center line F of the swing orbit. Note, the device shown in FIG. 1 is set up for practice by a right-handed golfer and can be set up for use by a left-handed player merely by moving the first sensor 16 to the other side of the center line F of the swing orbit, to a corresponding position in line with the third sensor 20. Also, the second sensor 18 and the third sensor 20 will detect an off-line swing such as an inside-out swing and an outside-in swing.

Preferably, the distance L between the first sensor 16 and the second sensor 18 (or third sensor 20 for a left-handed player) is approximately 10 centimeters, the distance P between the second sensor 18 and the third sensor 20 is approximately 4 centimeters, and the distance from the second sensor 18 and the third sensor 20 to the tee 14 in the direction of the swing orbit is approximately 4 to 5 centimeters (the distance from the second sensor 18 and the third sensor 20 to the golf ball 12 on the tee 14 is approximately 2 to 3 centimeters).

Referring again to FIG. 1, an indicating instrument 32 having a display 30 is provided near the mat 10, and is connected to the first, second and third sensors 16, 18 and 20 through a connector 34.

Referring to FIG. 3, the indicating instrument 32 includes a microcomputer unit 40, which comprises a central processing unit (CPU) 42 having control and arithmetic functions, a read only memory (ROM) 44 for storing a program, and a random access memory (RAM) 46 for storing data or the like. These elements are interconnected by a bus 48. Further, an input and output (I/O) interface 50 is provided for receiving the detection signals input by the sensors 16, 18 and 20, and for outputting those signals to the display 30. The microcomputer unit 40 operates in accordance with the flow charts of FIG. 5 or FIG. 6, to calculate a swing time substantially from a start of a backswing of the golf club to an impact of the head thereof with a golf ball in response to outputs of the sensors 16, 18 and 20, and to indicate the results thereof at the display 30.

The patterns of a swing of the golf club are now described with reference to FIGS. 4A to 4C. As described above, the second sensor 18 and the third sensor 20 are complementary to each other, and thus only the second sensor 18 is described here. Note, in the explanation given below, when the second sensor 18 is turned ON in practice the third sensor 20 may be turned ON. FIG. 4A shows a most general swing pattern in which the golfer addresses the ball by moving the golf club in the direction of the arrow 1, starts a backswing by moving the golf club in the direction of the arrow 2, and finally carries out a forward swing by moving the golf club in the direction of the arrow 3, to finally bring about an impact of the head with the ball. In this case, the head of the golf club passes through the first and second sensors in the order of 16-18-16-16-18. FIG. 4B shows a swing pattern in which the golfer addresses the ball by resting the head 24 of the golf club directly on the second sensor 18 from above, without passing through the first sensor 16, starts a backswing by moving the golf club in the direction of the arrow 1, and carries out a forward swing by moving the golf club in the direction of the arrow 2. In this case, the head 24 of the golf club passes through the first and second sensors in the order of 18-16-16-18. FIG. 4C shows a case in which the tee 14 is detached from the mat 10 and the golf ball 12 is set directly on the mat 10 near to the second sensor 18. Here, the golfer addresses the ball by resting the head 24 of the golf club on the mat 10 between the first and second sensors 16 and 18, starts a backswing by moving the golf club in the direction of the arrow 1, and carries out a forward swing by moving the golf club in the direction of the arrow 2. In this case, the head 24 of the golf club passes through the first and second sensors in the order of 16-16-18. Note, some golfers use a "waggle" swing by which the head 24 is moved past the first and second sensors 16 and 18 repeatedly before the start of the backswing. Nevertheless, it is clear that, in all cases, the head 24 of the golf club finally passes through the first and second sensors in the pattern of 16-16-18, from the actual start of the backswing to the point of impact with the ball.

Figure 5:
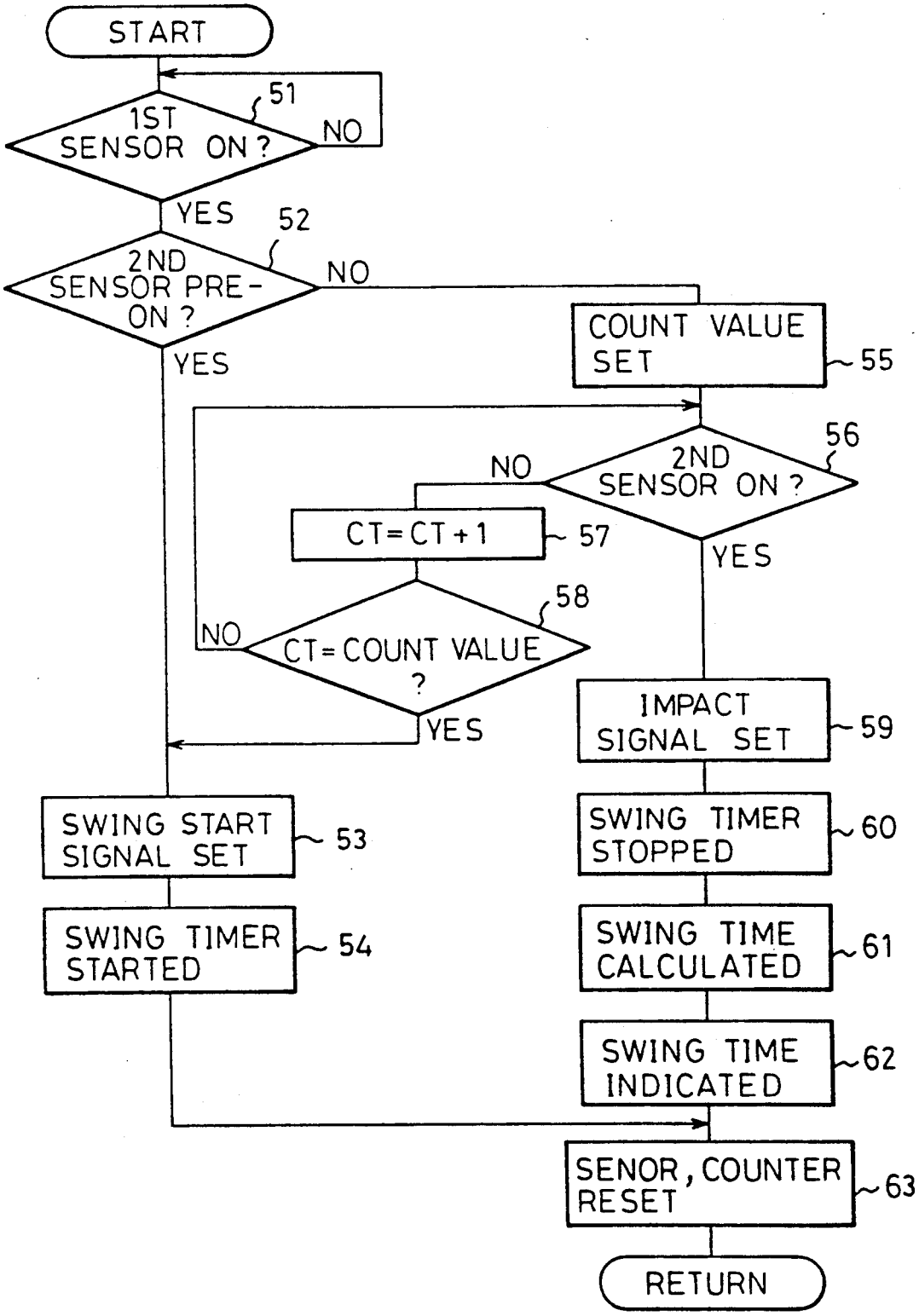
FIG. 5 is a flow chart of the process for calculating and indicating the swing time; and, FIG. 6 is a flow chart of another example of the process for calculating and indicating the swing time.

FIG. 5 is a flow chart of the process for calculating and indicating the swing time, which process is executed by the microcomputer 40 at predetermined intervals. In this process, an initialization of the program (not shown) is first carried out and the detected signals are stored. Further, in this embodiment, the first and second sensors 16 and 18 output ON signals, respectively, when detecting the passage of the head 24 of the golf club, and these ON signals are stored in the RAM 46 at predetermined regions respectively, and are reset by reset signals output when the program proceeds to step 63.

As shown in FIG. 5, at step 51, it is determined whether or not the first sensor 16 has output an ON signal. If the result at step 51 is YES, the program proceeds to step 52, but if the result is NO, that cycle is ended and the cycle restarted. As described above, the head 24 of the golf club finally passes through the first and second sensors in the pattern 16-16-18, from the start of the backswing to the point of impact, and accordingly, the determination at step 51 is used to detect the possible start of an actual backswing, and again to detect the subsequent forward swing. Note, the first sensor 16 may output several ON signals before entering the final pattern of 16-16-18, as explained above (for example, refer to FIG. 4A and the case of a waggle swing), but these additional ON signals are excluded from the swing time measurement procedure, as described later.

Then, at step 52, it is determined whether or not the second sensor 18 has output an ON signal prior to the output by the first sensor 16 of an ON signal. If the result is YES at step 52, the sensors have output ON signals in the order of 18-16, and thus the golf club must be in the course of a backswing. Accordingly, the program proceeds to step 53, at which a swing start signal is set, and then to step 54 where a swing timer is started to commence the measurement of the swing time. The program then proceeds to step 63, at which ON signals output by the first and second sensors 16 and 18 and stored in the RAM 46 are reset. Also, later described counter is reset.

Therefore, the result at step 51 in the next cycle is NO, and after the elapse of a certain time, the golf club will commence a forward swing and the first sensor 16 will again output an ON signal. Accordingly, the result at step 51 becomes YES and the result at step 52 NO, and thus the program proceeds to steps 55 and 56.

Note, the program will also proceed from steps 51 and 52 to steps 55 and 56 when the result at step 51 is YES and the result at step 52 is initially NO (for example, refer to FIG. 4C).

At step 55, a count value is set, which value relates to a time taken by the head 24 of the golf club to move from the first sensor 16 to the second sensor 18, and at step 56, it is determined whether or not the second sensor 18 has output an ON signal.

This count value is a short time corresponding, for example, to that taken by the head 24 of the golf club when moving at a speed of 10 to 20 meters per second (this speed will be slower for the average golfer), and it can be judged that the head speed is high enough to correspond to an impact, i.e., the golf club is making an impact with the ball if the detected time taken by the head 24 of the golf club to move from the first sensor 16 to the second sensor 18 is within this count value. Conversely, it can be judged that the head speed is not high enough to correspond to an impact, and the golf club is not making an impact with ball, if the second sensor 18 does not output an ON signal while this predetermined count value (time) is counted after the first sensor 16 has output an ON signal.

Accordingly, if the result at step 56 is NO, the program proceeds to step 57 where the counter CT is counted up by one, and then proceeds to step 58 to determine whether the counted value CT is equal to the predetermined count value. If the result at step 58 is NO, that cycle is ended and the next cycle is started from step 56 and the count is continued while determining if the second sensor 18 has output an ON signal. In this way, it can be judged that an impact has occurred if the result at step 56 becomes YES before the counted value CT becomes equal to the predetermined count value. The program then proceeds to step 59 where an impact signal is set to light a lamp in the display 30, and to step 60 where the swing timer is stopped. Then, at step 61, the swing time is calculated from data obtained at steps 54 and 60, and at step 62, the calculated swing time is indicated at the display 30. Then, at step 63, the ON signals output by the first and second sensors 16 and 18 and the counter CT are reset.

If, however, at step 58 the counted value CT becomes equal to the predetermined count value, it is determined that the second sensor 18 has not output an ON signal within the predetermined count value (time) after the first sensor 16 has output an ON signal, and thus the golf club is not about to make an impact with the ball. Therefore, the program proceeds to step 53 where a swing start signal is set to light a lamp of the display 30, and to step 54 where the swing timer is started to commence the measurement of the swing time. The program then proceeds to step 63 where the ON signals output by the first and second sensors 16 and 18 and the counter CT are reset. Namely, the measurement of the swing time is restarted by passing through steps 58 to 53, even if the result at step 52 was YES, and in the case of a waggle swing, and thereafter, the swing time is calculated if the result at step 56 becomes YES after the first sensor 16 has output a next ON signal.

In this way, it is possible to determine whether the ON signal output by the first sensor 16 represents an impact or other swing states, including a backswing and a forward swing during an address of the ball.

Figure 6:
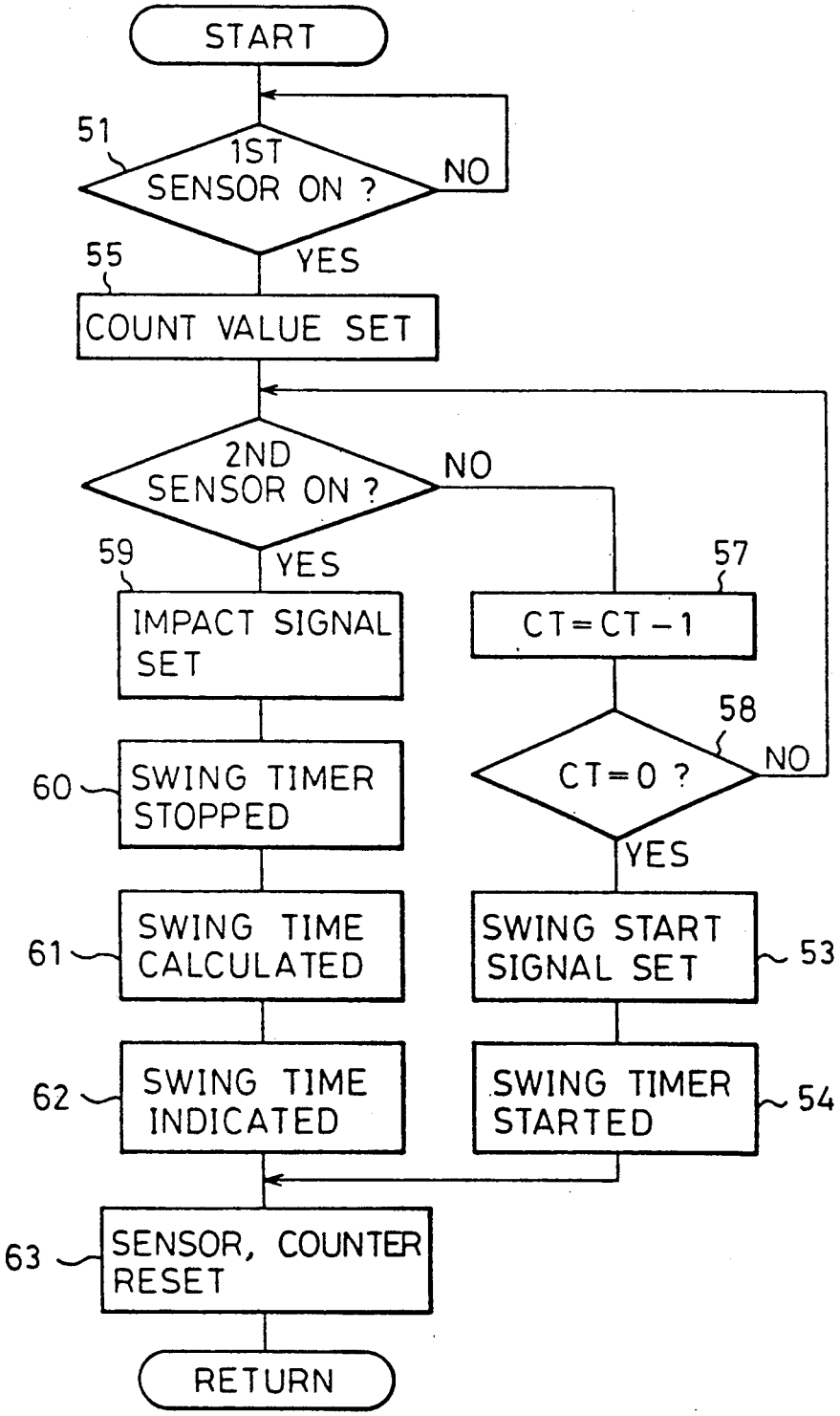

FIG. 6 is a flow chart of another example of the process for calculating and indicating the swing time. FIG. 6 is very similar to FIG. 5, except that step 52 in FIG. 5 is omitted in FIG. 6, and thus the same reference numbers are given to the same steps. Also, in FIG. 6, a count value is set at step 55 and a subtraction is made from the count value at step 57, and it is then determined whether value at the counter CT has reached zero. Nevertheless, it is possible to obtain identical results for determining the elapsed time, by either an addition or subtraction, and thus the corresponding steps can be considered identical in FIGS. 5 and 6.

As explained above, according to the present invention, there is provided a golf practice device comprising a swing time calculating means for calculating a swing time substantially from a start of a back swing of the golf club to a point at which an impact with a ball occurs, and an indicating means for indicating a result of the calculation, so that a golfer can observe the indicated result and practice until achieving a swing having a constant rhythm, without the need for many cumbersome check points. Accordingly, in actual play the distance of flight of the golf ball will be longer, due to the stable swing, and it is possible to practice the different swings needed for each golf club.

While the invention has been particularly shown and described in reference to preferred embodiments thereof, it will be understood by those skilled in the art that changes in form and details may be made therein without departing from the spirit and scope of the invention.

We claim:

1. A golf practice device for calculating a time for a full swing of a golfer, comprising:

a mat on which a golf ball is set;

at least first and second sensors arranged in said mat and spaced from each other in the direction of a swing orbit of a head of a golf club, wherein said at least said first and second sensors emit first and second output signals, respectively, as said head of said golf club passes thereabove;

a swing time calculating means for distinguishing a full swing from a checking incomplete swing, and for calculating a swing time of said full swing substantially from a start of a back swing of said golf club to a time at which an impact is made by said club head with a golf ball, in response to said output signals emitted from said at least said first and second sensors which emit said output signals in the following pattern: (1) a first emitting by said first sensor of said first output signal, (2) a second emitting by said first sensor of said first output signal, and then (3) an emitting by said second sensor of said second output signal; and an indicating means for indicating the time calculated by said swing time calculating means, wherein said swing time calculating means calculates as a swing time from the first emitting by said first sensor of said first output signal to the emitting by said second sensor of said second output signal, wherein an incomplete swing is checked by a time from the second emitting by said first sensor of said first output signal to the emitting by said second sensor of said second output signal, wherein said incomplete swing is checked by starting an increment or decrement of a count value CT when said second emitting of said first output signal by said first sensor occurs, and said incomplete swing is determined if said second sensor does not emit a signal prior to a count over said count value CT so that a measurement of said swing time is reset thereafter.

2. A golf practice device according to claim 1, wherein at least said first sensor and said second sensor are arranged between said golf ball sitting on said mat and said golfer ready to execute a club swing.

3. A golf practice device according to claim 2, further comprising a third sensor arranged opposite a side of said at least said first sensor and said second sensor where said golfer is located.

4. A golf practice device according to claim 1, wherein said first sensor is located further away than a location of said second sensor in relation to said golf ball.

* * * * *